US005913194A

United States Patent [19]

Karaali et al.

[11] Patent Number: 5,913,194

[45] Date of Patent: Jun. 15, 1999

[54] METHOD, DEVICE AND SYSTEM FOR USING STATISTICAL INFORMATION TO REDUCE COMPUTATION AND MEMORY REQUIREMENTS OF A NEURAL NETWORK BASED SPEECH SYNTHESIS SYSTEM

[75] Inventors: Orhan Karaali, Rolling Meadows; Noel Massey, Schaumburg; Gerald Corrigan, Chicago, all of Ill.

[73] Assignee: Motorola, Inc., Schaumburg, Ill.

[21] Appl. No.: 08/892,295

[22] Filed: Jul. 14, 1997

[51] Int. Cl.[6] ..... G10L 5/02

[52] U.S. Cl. ..... 704/259; 704/265

[58] Field of Search ..... 704/259, 265, 704/258

[56] References Cited

U.S. PATENT DOCUMENTS 5,668,926 9/1997 Karaali et al. .

OTHER PUBLICATIONS

"From Text To Speech—The MITalk System" by Jonathan Allen, M. Sharon Hunnicutt and Dennis Klatt; Cambridge University Press, pp. 108–122 and 181–201.

"Speech Communication—Human and Machine" by Douglas O'Shaughnessy, INRS–Telecommunications; Addison–Wesley Publishing Company, pp. 55–63.

*Primary Examiner*—David R. Hudspeth
*Assistant Examiner*—Harold Zintel
*Attorney, Agent, or Firm*—Darleen J. Stockley

[57] ABSTRACT

A method (400), device and system (300) provide, in response to linguistic information, efficient generation of a parametric representation of speech using a neural network. The method provides, in response to linguistic information efficient generation of a refined parametric representation of speech, comprising the steps of: A) using a data selection module to retrieve representative parameter vectors for each segment description according to the phonetic segment type and the phonetic segment types included in adjacent segment descriptions; B) interpolating between the representative parameter vectors according to the segment descriptions and duration to provide interpolated statistical parameters; C) converting the interpolated statistical parameters and linguistic information to neural network input parameters; D) utilizing a statistically enhanced neural network/neural network with post-processor to provide neural network output parameters that correspond to a parametric representation of speech; and converting the neural network output parameters to a refined parametric representation of speech.

90 Claims, 5 Drawing Sheets

300

200

300

400

METHOD, DEVICE AND SYSTEM FOR USING STATISTICAL INFORMATION TO REDUCE COMPUTATION AND MEMORY REQUIREMENTS OF A NEURAL NETWORK BASED SPEECH SYNTHESIS SYSTEM

FIELD OF THE INVENTION

The present invention relates to neural network-based coder parameter generating systems used in speech synthesis, and more particularly to use of statistical information in neural network-based coder parameter generating systems used in speech synthesis.

BACKGROUND OF THE INVENTION

As shown in FIG. 1, numeral 100, to generate synthetic speech (118) a pre-processor (110) typically converts linguistic information (106) into normalized linguistic information (114) that is suitable for input to a neural network. The neural network module (102) converts the normalized linguistic information (114), which can include parameters describing phoneme identifier, segment duration, stress, syllable boundaries, word class, and prosodic information, into neural network output parameters (116). The neural network output parameters are scaled by a post-processor (112) in order to generate a parametric representation of speech (108) which characterizes the speech waveform. The parametric representation of speech (108) is converted to synthetic speech (118) by a waveform synthesizer (104). The neural network system performs the conversion from linguistic information to a parametric representation of speech by attempting to extract salient features from a database. The database typically contains parametric representations of recorded speech and the corresponding linguistic information labels. It is desirable that the neural network be able to extract sufficient information from the database which will allow the conversion of novel phonetic representations into satisfactory speech parameters.

One problem with neural network approaches is that the size of the neural network must be fairly large in order to perform a satisfactory conversion from linguistic information to parametric representations of speech. The computation and memory requirements of the neural network may exceed the available resources. If the computation and memory requirements of the neural network based speech synthesizer are required to be reduced, the standard approach is to reduce the size of the neural network by reducing at least one of: A) the number of neurons and B) the number of connections in the neural network. Unfortunately this approach often causes a substantial degradation in the quality of the synthetic speech. Thus, the neural network based speech synthesis system performs poorly when the neural networks are scaled to meet typical computation and memory requirements.

Hence, there is a need for a method, device, and system for reducing the computation and memory requirements of a neural network based speech synthesis system without substantial degradation in the quality of the synthetic speech.

DETAILED DESCRIPTION OF A PREFERRED EMBODIMENT

The present invention provides a method, device and system for efficiently increasing the number of parameters which are input to the neural network in order to allow the size of the neural network to be reduced without substantial degradation in the quality of the generated synthetic speech.

Figure 1:
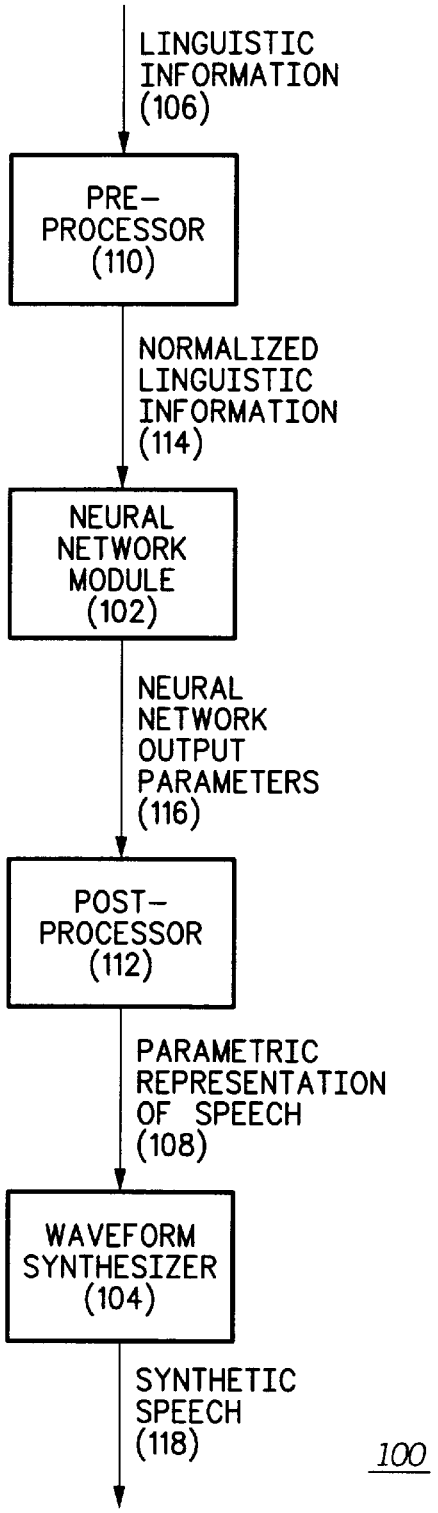
PRIOR ART FIG. 1
FIG. 1 is a schematic representation of a neural network system for synthesizing waveforms for speech as is known in the art.
Figure 2:
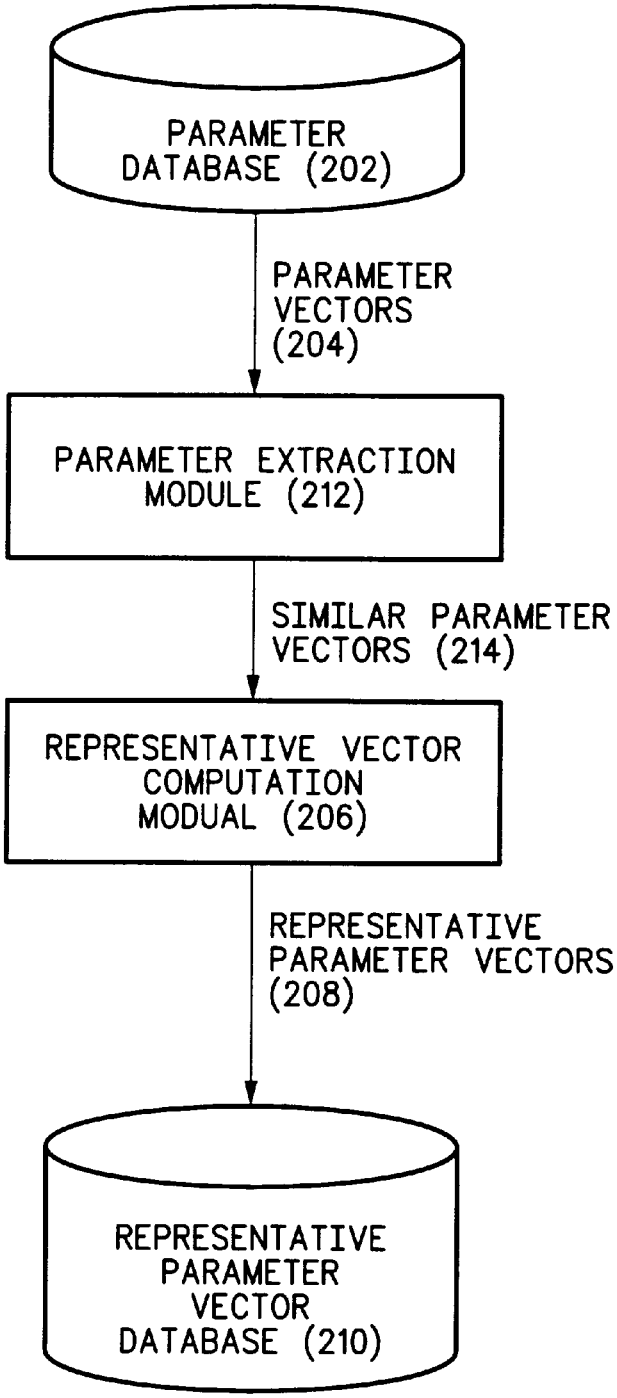
FIG. 2 is a schematic representation of a system for creating a representative parameter vector database in accordance with the present invention.
Figure 3:
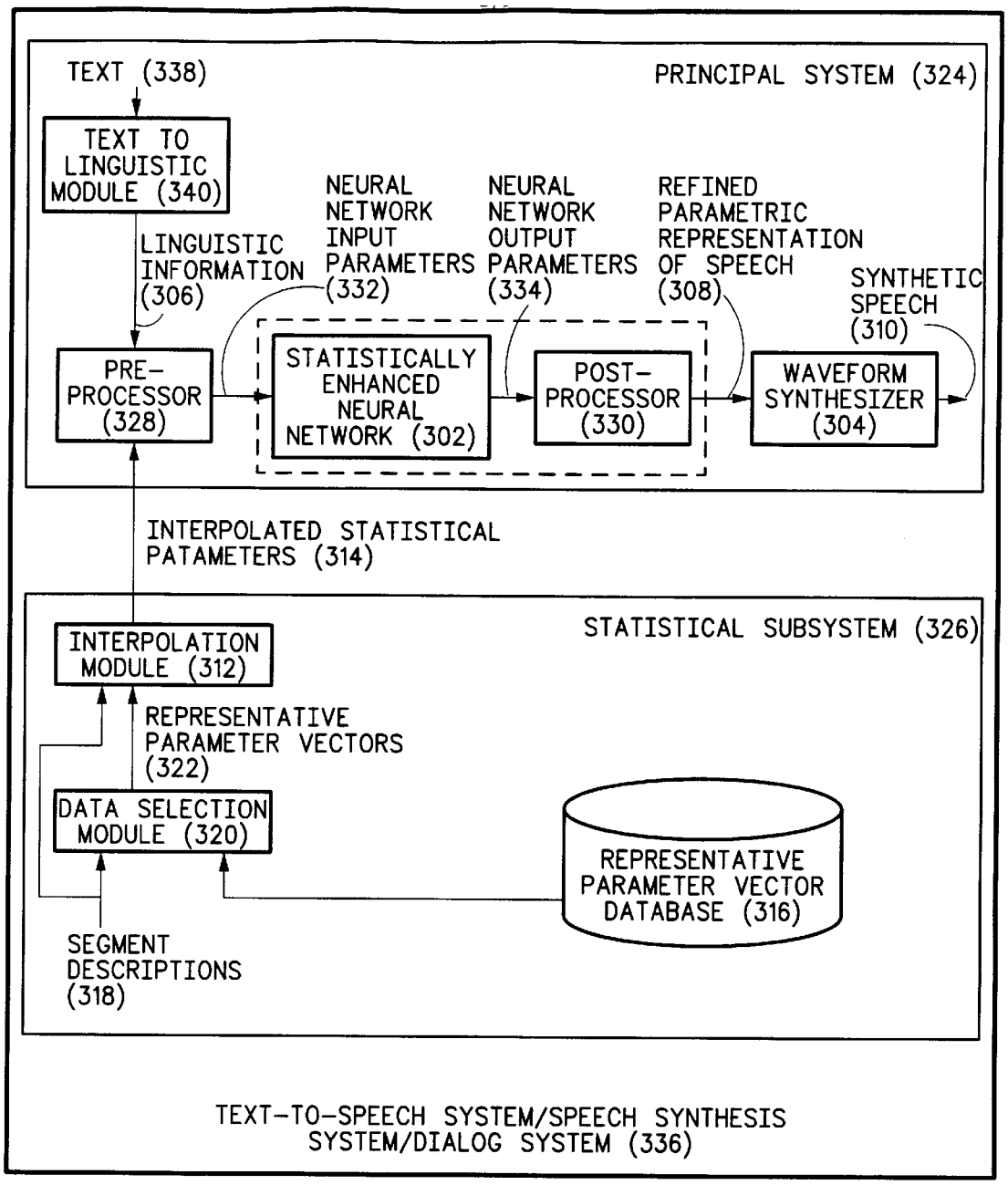
FIG. 3 is a schematic representation of one embodiment of a system in accordance with the present invention.

In a preferred embodiment, as shown in FIGS. 2 and 3, numeral 200 and 300 respectively, the representative parameter vector database (316, 210) is a collection of vectors which are parametric representations of speech that describe a triphone. A triphone is an occurrence of a specific phoneme which is preceded by a specific phoneme and followed by a specific phoneme. For example, the triphone i-o-n is a simplified means of talking about the phoneme 'o' in the context when it is preceded by the phoneme 'i' and followed by the phoneme 'n'. The preferred embodiment for English speech would contain 73 unique phonemes and would therefore have 72*73*72=378,432 unique triphones. The number of triphones that are stored in the representative parameter vector database (316, 210) will typically be significantly smaller due to the size of the parameter database (202) that was used to derive the triphones and due to phonotactic constraints, which are constraints due to the nature of the specific language.

In the preferred embodiment, the parameter database (202) contains parametric representations of speech which were generated from a recording of a human speaker by using the analysis portion of a vocoder. A new set of coded speech parameters was generated for each 10 ms segment of speech. Each set of coded speech parameters is composed of pitch, total energy in the 10 ms frame, information describing the degree of voicing in specified frequency bands, and 10 spectral parameters which are derived by linear predictive coding of the frequency spectrum. The parameters are stored with phonetic, syntactic, and prosodic information describing each set of parameters. The representative parameter vector database is generated by:

A) using a parameter extraction module (212) to collect all occurrences of the coded speech vectors (parameter vectors, 204) which correspond to a specific quadrant of each segment of the middle phoneme of a specific triphone segment in the parameter database (202), where the quadrant is selected from the four quadrants which are defined as the time segments that are determined by dividing each phoneme segment into four segments such that the duration of each quadrant is identical and the sum of the durations of the four segments equals the duration of this instance of the phoneme, in order to create a set of all coded speech vectors for a specified quadrant of a specified triphone (similar parameter vectors, 214);

B) using a k-means clustering module (representative vector computation module, 206) to cluster the specified triphone quadrant data into 3 clusters, as in known in the art;

C) storing the centroid from the cluster with the most members (representative parameter vector, 208) in the representative parameter vector database (210, 316), and;

D) repeating steps A–C for all quadrants and all triphones.

In addition to the centroids (representative parameter vectors, 208) derived from triphone data, the process is repeated in order to create centroids (representative parameter vectors, 208) for segments representing pairs of phonemes, also known as diphone segments, and for segments representing context independent single phonetic segments.

As an example of the method, the following steps would be followed in order to store the 4 representative parameter vectors for the phoneme 'i' in the context where it is preceded by the phoneme 'k' and followed by the phoneme 'n'. In the context of the present invention, this phoneme sequence is referred to as the triphone 'k-i-n'. The parameter extraction module (212) will first search the parameter database (202) for all occurrences of the phoneme 'i' in the triphone 'k-i-n' which can be any one of A) in the middle of a word; B) at the beginning of a word, if there is not an unusual pause between the two consecutive words and the previous word ended with the phoneme 'k' and the current word starts with the phonemes 'i-n', and; C) at the end of a word if there is not an unusual pause between the two consecutive words and the current word ends with the phonemes 'k-i' and the following word starts with the phoneme 'n'. Every time the triphone k-i-n occurred in the data, the clustering module would find the starting and ending time of the middle phonetic segment, 'i' in the example triphone 'k-i-n', and break the segment into four segments, referred to as quadrants, such that the duration of each quadrant was identical and the sum of the durations of the four quadrants equaled the duration of this instance of the phoneme 'i'. In order to find the first of the 4 representative parameter vectors for the triphone 'k-i-n' the parameter extraction module (212) collects all the parameter vectors (204) that fell in the first quadrant of all the instances of the phoneme 'i' in the context where it is preceded by the phoneme 'k' and followed by the phoneme 'n'. The total number of parameter vectors in each quadrant may change for every instance of the triphone depending on the duration of each instance. One instance of the 'i' in the triphone 'k-i-n' may have 10 frames whereas another instance may contain 14 frames. Once all the parameter vectors for a triphone have been collected, each element of the similar parameter vectors (214) is normalized across all of the collected parameter vectors such that each element has a minimum value of 0 and a maximum value of 1. This normalizes the vector such that each element receives the same weight in the clustering. Alternatively the elements may normalized is such a way that certain elements, such as the spectral parameters, have a maximum greater than one thereby receiving more importance in the clustering. The normalized vectors are then clustered into three regions according to a standard k-means clustering algorithm. The centroid from the region that has the largest number of members is unnormalized and used at the representative parameter vector (208) for the first quadrant. The extraction and clustering procedure is repeated for the three remaining quadrants for the triphone 'k-i-n'. This procedure is repeated for all possible triphones.

In addition to the triphone data, 4 quadrant centroids would be generated for the phoneme pair 'k-i', referred to the diphone 'k-i', by collecting the parameter vectors in the parameter database (202) that correspond to the phoneme 'k' when it is followed by the phoneme 'i'. As described above, these parameters are normalized and clustered. Again the centroid from the largest of the 3 clusters for each of the 4 quadrants is stored in the representative parameter vector database. This process is repeated for all diphones, 73*72=5256 diphones in the preferred English representation.

In addition to the triphone and diphone data, context independent phoneme information is also gathered. In this case, the parameter vectors for all instances of the phoneme 'i' are collected independent of the preceding or following phonemes. As described above, this data is normalized and clustered and for each of the 4 quadrants the centroid from the cluster with the most members is stored in the representative parameter vector database. The process is repeated for each phoneme, 73 in the preferred English representation.

During normal execution of the system, the preferred embodiment uses the labels of the phoneme sequence (segment descriptions, 318) to select (data selection module, 320) the quadrant centroids (representative parameter vectors, 322) from the representative parameter vector database (316). For example, if the system were required to synthesize the phoneme 'i' which was contained in the triphone 'I-i-b', then the data selection module (320) would select the 4 quadrant centroids for the triphone 'I-i-b' from the representative parameter vector database. If this triphone was not in the triphone database, the statistical subsystem must still provide interpolated statistical parameters (314) to the preprocessor (328). In this case statistical data is provided for the phoneme 'i' in this context by using the first 2 quadrant values from the "I-i" diphone and the third and fourth quadrant values from the 'i-b' diphone. Similarly if neither the 'I-i-b' triphone nor the 'i-b' diphone existed in the database, then the statistical data for the third quadrant may come from the context independent data for the phoneme 'i' and the statistical data for the fourth quadrant may come from the context independent data for the phoneme 'b'. Once the quadrant centroids are selected, the interpolation module (312) computes a linear average of the elements of the centroids according to segment durations (segment descriptions, 318) in order to provide interpolated statistical parameters (314). Alternatively a cubic spline interpolation algorithm or Lagrange interpolation algorithm may be used to generate the interpolated statistical parameters (314). These interpolated statistical parameters are parametric representations of speech which are suitable for conversion to synthetic speech by the waveform synthesizer. However synthesizing speech from only the interpolated parameters would produce low quality synthetic speech. Instead, the interpolated statistical parameters (314) are combined with linguistic information (306) and scaled by pre-processor (328) in order to generate neural network input parameters (332). The neural network input parameters (332) are presented as input to a statistically enhanced neural network (302). Prior to execution, the statistically enhanced neural network is trained to predict the scaled parametric representations of speech which are stored in the parameter database (202) when the corresponding linguistic information, which is also stored in the parameter database and contains the segment descriptions (318), and the interpolated statistical parameters (314) are used as input. During normal execution, the neural network module receives novel neural network input parameters (332), which are derived from novel interpolated statistical parameters (314) and linguistic information (306) which contains novel segment descriptions (318) in order to generate neural network output parameters (334). The linguistic information is derived from novel text (338) by a text to linguistics module (340). The neural network output parameters (334) are converted to a refined parametric representation of speech (308) by a post-processor (330) which typically performs a linear scaling of each element of the neural network output parameters (334). The refined parametric representation of speech (308) is provided to a waveform synthesizer (304) which converts the refined parametric representation of speech to synthetic speech (310).

In the event where it is desirable that the representative parameter vector database (210, 316) be reduced in size, then the representative parameter vector database (210, 316) may contain at least one of: A) select triphone data, such as frequently used triphone data; B) diphone data, and C) context independent phoneme data. Reducing the size of the representative parameter vector database (210, 316) will provide interpolated statistical parameters that less accurately describe the phonetic segment and may therefore require a larger neural network to provide the same quality of refined parametric representations of speech (308), but the tradeoff between triphone database size and neural network size may be made depending on the system requirements.

Figure 5:
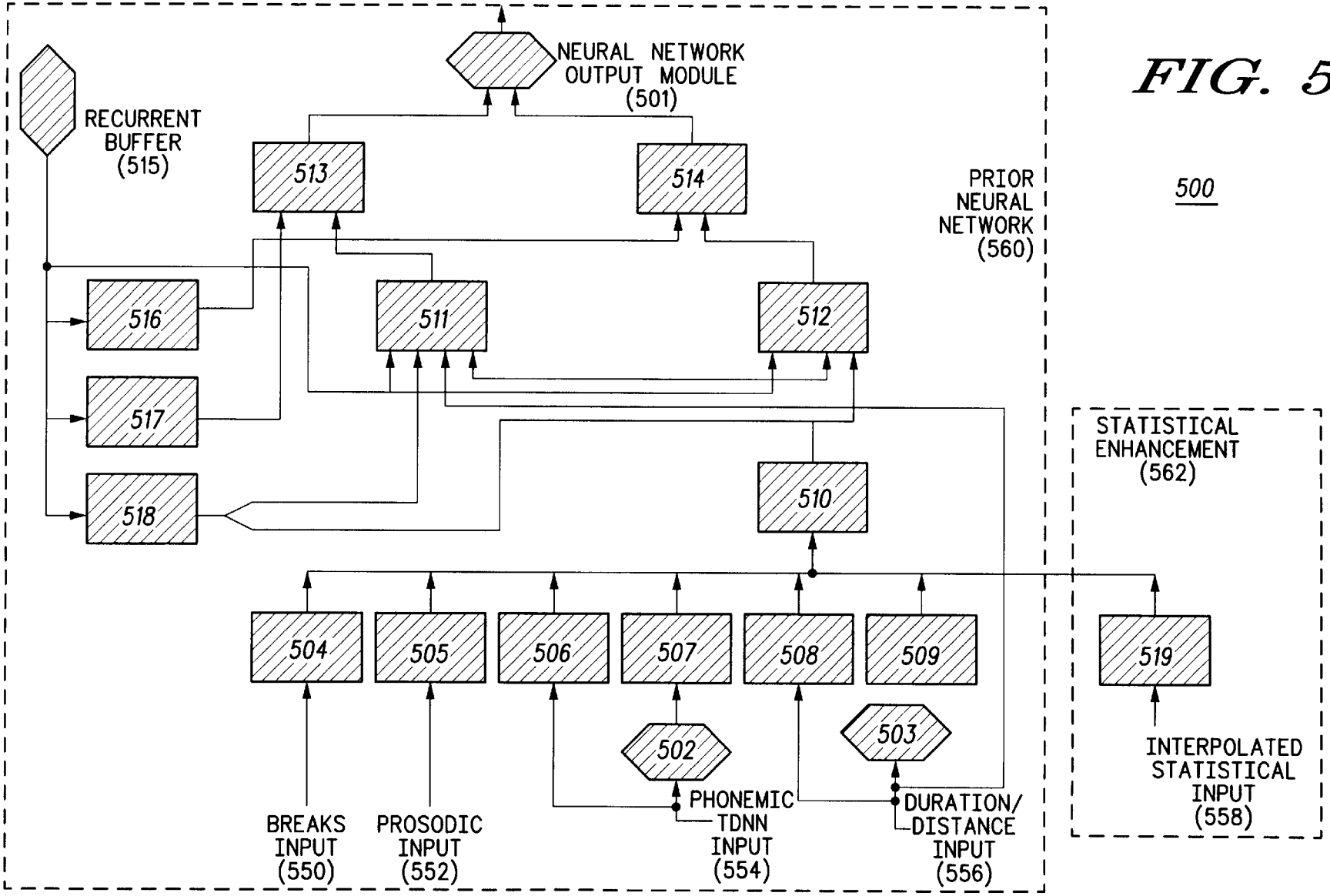
FIG. 5 shows a schematic representation of an embodiment of a statistically enhanced neural network in accordance with the present invention.

FIG. 5, numeral 500, shows a schematic representation of a preferred embodiment of a statistically enhanced neural network in accordance with the present invention. The input to the neural network consists of: A) break input (550) which describes the amount of disjuncture in the current and surrounding segments, B) the prosodic input (552) which describes distances and types of phrase accents, pitch contours, and pitch accents of current and surrounding segments, C) the phonemic Time Delay Neural Network TDNN input (554) which uses a non-linear time-delay input sampling of the phoneme identifier as described in U.S. Pat. No. 5,668,926 (A Method and Apparatus for Converting Text Into Audible Signals Using a Neural Network, by Orhan Karaali, Gerald E. Corrigan and Ira A. Gerson, filed Mar. 22, 1996 and assigned to Motorola, Inc.) , D) duration/distance input (556) which describes the distances to word, phrase, clause, and sentence boundaries and the durations, distances, and sum over all segment frames of 1/(segment frame number) of the previous 5 phonemes and the next 5 phonemes in the phoneme sequence, and E) the interpolated statistical input (558) which is the output of the statistical subsystem (326) that has been coded for use with the neural network. The neural network output module (501) combines the output of the output layer modules and generates the refined parametric representation of speech (308) which is composed of pitch, total energy in the 10 millisecond frame, information describing the degree of voicing in specified frequency bands, and 10 line spectral frequency parameters.

The neural network is composed of modules wherein each module is at least one of: A) a single layer of processing elements with a specified activation function; B) a multiple layer of processing elements with specified activation functions; C) a rule based system that generates output based on internal rules and input to the module; D) a statistical system that generates output based on the input and an internal statistical function, and E) a recurrent feedback mechanism. The neural network was hand modularized according to speech domain expertise as is known in the art.

The neural network contains two phoneme-to-feature blocks (502, 503) which use rules to convert the unique phoneme identifier contained in both the phonemic TDNN input (554) and the duration/distance input (556) to a set of predetermined acoustic features such as sonorant, obstruent, and voiced. The neural network also contains a recurrent buffer (515) which is a module that contains a recurrent feedback mechanism. This mechanism stores the output parameters for a specified number of previously generated frames and feeds the previous output parameters back to other modules which use the output of the recurrent buffer (515) as input.

The square blocks in FIG. 5 (504–514, 516–519) are modules which contain a single layer of perceptrons. The neural network input layer is composed of several single layer perceptron modules (504, 505, 506, 507, 508, 509, 519) which have no connections between each other. All of the modules in the input layer feed into the first hidden layer (510). The output from the recurrent buffer (515) is processed by a layer of perceptron modules (516, 517, 518). The information from the recurrent buffer, the recurrent buffer layer of perceptron modules (516, 517, 518), and the output of the first hidden layer (510) is fed into a second hidden layer (511, 512) which in turn feeds the output layer (513, 514).

Since the number of neurons is necessary information in defining a neural network, the following table shows the details about each module for a preferred embodiment:

| ITEM Number | Module Type | Number of Inputs | Number of Outputs |
|---|---|---|---|
| 501 | rule | 14 | 14 |
| 502 | rule | 2280 | 1680 |
| 503 | rule | 438 | 318 |
| 504 | single layer perceptron, sigmoid activation | 26 | 15 |
| 505 | single layer perceptron, sigmoid activation | 47 | 15 |
| 506 | single layer perceptron, sigmoid activation | 2280 | 15 |
| 507 | single layer perceptron, sigmoid activation | 1680 | 15 |
| 508 | single layer perceptron, sigmoid activation | 446 | 15 |
| 509 | single layer perceptron, sigmoid activation | 318 | 10 |
| 510 | single layer perceptron, sigmoid activation | 99 | 120 |
| 511 | single layer perceptron, sigmoid activation | 82 | 30 |
| 512 | single layer perceptron, sigmoid activation | 114 | 40 |
| 513 | single layer perceptron, sigmoid activation | 40 | 4 |
| 514 | single layer perceptron, sigmoid activation | 45 | 10 |
| 515 | recurrent mechanism | 14 | 140 |
| 516 | single layer perceptron, sigmoid activation | 140 | 5 |
| 517 | single layer perceptron, sigmoid activation | 140 | 10 |
| 518 | single layer perceptron, sigmoid activation | 140 | 20 |
| 519 | single layer perceptron, sigmoid activation | 14 | 14 |

For single layer perceptron modules in the proceeding table the number of outputs is equal to the number of processing elements in each module. In the preferred embodiment, the neural network is trained using a back-propagation of errors algorithm, as is known in the art. An alternative gradient descent technique may also be used and a Bayesian technique may alternatively be used to train the neural network. These techniques are known in the art.

FIG. 3 shows a schematic representation of one embodiment of a system in accordance with the present invention. The present invention contains a statistically enhanced neural network which extracts domain-specific information by learning relations between the input data, which contains processed (pre-processor, 328) versions of the interpolated statistical parameters (314) in addition to the typical linguistic information (306), and the neural network output parameters (334) which is processed (post-processor, 330) in order to generate coder parameters (refined parametric representations of speech, 308). The linguistic information (306) is generated from text (338) by a text to linguistics module (340). The coder parameters are converted to synthetic speech (310) a waveform synthesizer (304). The statistical subsystem (326) provides the statistical information to the neural network during both the training and testing phases of the neural network based speech synthesis system. If desired, the post-processor (330) can be combined with the statistically enhanced neural network by modifying the neural network output module to generate the refined parametric representation of speech (308) directly.

In the preferred embodiment, the interpolated statistical parameters (314) which are generated by the statistical subsystem (326) are composed of parametric representations of speech which may be converted to synthetic speech through the use of a waveform synthesizer(304). However, unlike the neural network generated coder parameters (refined parametric representation of speech, 308) the interpolated statistical parameters are generated based only on the statistical data stored in the representative parameter vector database (316) and the segment descriptions (318), which contain the sequence of phonemes to be synthesized and their respective durations.

Since the triphone database only contains information for each of four quadrants of each triphone, the statistical subsystem (326) must interpolate in order to provide the interpolated statistical parameters (314) between quadrant centers. Linear interpolation of the quadrant centers works best for this interpolation, though alternatively Lagrange interpolation and cubic spline interpolation may also be used.

In the preferred embodiment, the refined parametric representation of speech (308) is a vector that is updated every 10 ms. The vector is composed of 13 elements: one describing the fundamental frequency of the speech, one describing the frequency of the voiced/unvoiced bands, one describing the total energy of the 10 ms frame, and 10 line spectral frequency parameters describing the frequency spectrum of the frame. The interpolated statistical parameters (314) are also composed of the same 13 elements: one describing the fundamental frequency of the speech, one describing the frequency of the voiced/unvoiced bands, one describing the total energy of the 10 ms frame, and 10 line spectral frequency parameters describing the frequency spectrum of the frame. Alternatively the elements of the interpolated statistical parameters may be derivations of the elements of the refined parametric representation of speech. For example, if the refined parametric representation of speech (308) is composed of the same 13 elements mentioned above: one describing the fundamental frequency of the speech, one describing the frequency of the voiced/unvoiced bands, one describing the total energy of the 10 ms frame, and 10 line spectral frequency parameters describing the frequency spectrum of the frame, then the interpolated statistical parameters (314) may be composed of 13 elements: one describing the fundamental frequency of the speech, one describing the frequency of the voiced/unvoiced bands, one describing the total energy of the 10 ms frame, and 10 reflection coefficient parameters describing the frequency spectrum of the frame. Since the reflection coefficients are just another means of describing the frequency spectrum and can be derived from line spectral frequencies, the elements of refined parametric representation of speech vectors are said to be derived from the elements of the interpolated statistical parameters. These vectors are generated by two separate devices, one from a neural network and the other from a statistical subsystem, so the values of each element of the vector are allowed to differ even if the meaning of the elements are identical. For example, the value of the second element, which is the total energy of the 10 ms frame, generated by the statistical subsystem will typically be different than the value of the second element, which is also the total energy of the 10 ms frame, generated by the neural network.

The interpolated statistical parameters (314) provide the neural network with a preliminary guess at the coder parameters and by doing so allow the neural network to be reduced in size. The role of the neural network has now changed from generating coder parameters from a linguistic representation of speech to the role of using linguistic information to refine the rough estimate of coder parameters which are based on statistical information.

Figure 4:
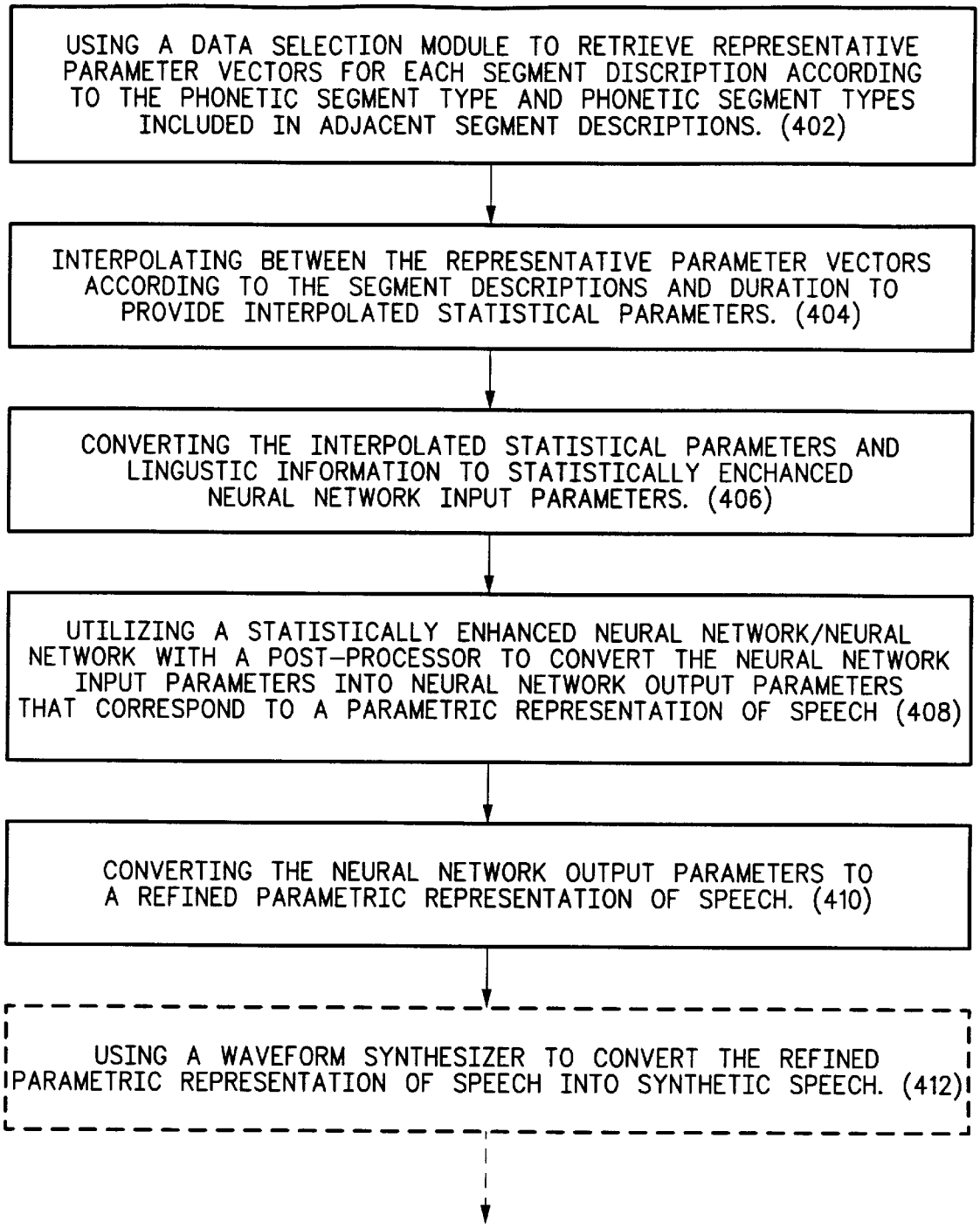
FIG. 4 is a flow chart of one embodiment of steps in accordance with the method of the present invention.

As shown in the steps set forth in FIG. 4, numeral 400, the method of the present invention provides, in response to linguistic information, efficient generation of a refined parametric representation of speech. The method includes the steps of: A) using (402) a data selection module to retrieve representative parameter vectors for each segment description according to the phonetic segment type and phonetic segment types included in adjacent segment descriptions; B) interpolating (404) between the representative parameter vectors according to the segment descriptions and duration to provide interpolated statistical parameters; C) converting (406) the interpolated statistical parameters and linguistic information to statistically enhanced neural network input parameters; D) utilizing (408) a statistically enhanced neural network/neural network with a post-processor to convert the neural network input parameters into neural network output parameters that correspond to a parametric representation of speech and converting (410) the neural network output parameters to a refined parametric representation of speech. In the preferred embodiment the method would also include the step of using (412) a waveform synthesizer to convert the refined parametric representation of speech into synthetic speech.

Software implementing the method may be embedded in a microprocessor or a digital signal processor. Alternatively, an application specific integrated circuit may implement the method, or a combination of any of these implementations may be used.

In the present invention, the coder parameter generating system is divided into a principal system (324) and a statistical subsystem (326), wherein the principal system (324) generates the synthetic speech and the statistical subsystem (326) generates the statistical parameters which allow the size of the principal system to be reduced.

The present invention may be implemented by a device for providing, in response to linguistic information, efficient generation of synthetic speech. The device includes a neural network coupled to receive linguistic information and statistical parameters, for providing a set of coder parameters. The waveform synthesizer is coupled to receive the coder parameters for providing a synthetic speech waveform. The device also includes an interpolation module which is coupled to receive segment descriptions and representative parameter vectors for providing interpolated statistical parameters.

The device of the present invention is typically a microprocessor, a digital signal processor, an application specific integrated circuit, or a combination of these.

The device of the present invention may be implemented in a text-to-speech system, a speech synthesis system, or a dialog system (336).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A method for providing, in response to linguistic information that includes a sequence of segment descriptions each of which includes a phonetic segment type and duration, efficient generation of a refined parametric representation of speech for providing synthetic speech, comprising the steps of:

A) using a data selection module to retrieve representative parameter vectors for each segment description according to at least the phonetic segment type and phonetic segment types included in adjacent segment descriptions;

B) interpolating between the representative parameter vectors according to the segment descriptions to provide interpolated statistical parameters;

C) converting the interpolated statistical parameters and linguistic information to neural network input parameters;

D) utilizing a neural network with a post-processor to convert the neural network input parameters into neural network output parameters that correspond to a parametric representation of speech and converting the neural network output parameters to a refined parametric representation of speech, wherein the refined parametric representation of speech can be used to provide synthetic speech.

2. The method of claim 1 wherein the refined parametric representation of speech is a sequence of coder parameters suitable to be provided to a waveform synthesizer.

3. The method of claim 2 further including a step of providing the refined parametric representation of speech to a waveform synthesizer to synthesize speech.

4. The method of claim 1 wherein the interpolating between the representative parameter vectors is performed using a linear interpolation algorithm.

5. The method of claim 1 wherein the interpolating between the representative parameter vectors is performed using a non-linear interpolation algorithm.

6. The method of claim 5 wherein the non-linear interpolation algorithm is a cubic spline interpolation algorithm.

7. The method of claim 5 wherein the non-linear interpolation algorithm is a Lagrange interpolation algorithm.

8. The method of claim 1 wherein elements of the interpolated statistical parameters correspond to elements of the refined parametric representation of speech.

9. The method of claim 1 wherein elements of the interpolated statistical parameters are derived from elements of the neural network output parameters.

10. The method of claim 1 wherein the representative parameter vectors are retrieved according to linguistic context which is derived from one of:

A) a phonetic segment sequence;

B) articulatory features;

C) acoustic features;

D) stress;

E) prosody;

F) syntax; and

G) a combination of at least two of A–F.

11. The method of claim 1 wherein the statistically enhanced neural network is a feedforward neural network.

12. The method of claim 1 wherein the statistically enhanced neural network contains a recurrent feedback mechanism.

13. The method of claim 1 wherein the statistically enhanced neural network is a multi-layer perceptron.

14. The method of claim 1 wherein the statistically enhanced neural network input includes a tapped delay line input.

15. The method of claim 1 wherein the statistically enhanced neural network is trained using a gradient descent technique.

16. The method of claim 1 wherein the statistically enhanced neural network is trained using a Bayesian technique.

17. The method of claim 1 wherein the statistically enhanced neural network is trained using back-propagation of errors.

18. The method of claim 1 wherein the statistically enhanced neural network is composed of a layer of processing elements with a predetermined specified activation function and at least one of:

A) another layer of processing elements with a predetermined specified activation function;

B) a multiple layer of processing elements with predetermined specified activation functions;

C) a rule-based module that generates output based on internal rules and input to the rule-based module;

D) a statistical system that generates output based on input and an internal statistical function; and E) a recurrent feedback mechanism.

19. The method of claim 1 wherein the statistically enhanced neural network input information includes at least one of:

A) a phoneme identifier associated with each phoneme in current and adjacent segment descriptions;

B) articulatory features associated with each phoneme in current and adjacent segment descriptions;

C) locations of syllable, word and other predetermined syntactic and intonational boundaries;

D) duration of time between syllable, word and other predetermined syntactic and intonational boundaries;

E) syllable strength information;

F) descriptive information of a word type, and;

G) prosodic information which includes at least one of:

1) locations of word endings and degree of disjuncture between words;

2) locations of pitch accents and a form of the pitch accents;

3) locations of boundaries marked in pitch contours and a form of the boundaries;

4) time separating marked prosodic events, and;

5) a number of prosodic events of a predetermined type in a time period separating a prosodic event of another predetermined type and a frame for which the refined parametric representation of speech is being generated.

20. The method of claim 1 wherein the representative parameter vectors are generated by using a predetermined clustering algorithm.

21. The method of claim 20 wherein the clustering algorithm is a k-means clustering algorithm.

22. The method of claim 1 wherein the representative parameter vectors are generated by using an averaging algorithm.

23. The method of claim 1 wherein the representative parameter vectors are derived by:

A) extracting vectors from a parameter database to create a set of similar parameter vectors; and B) computing a representative parameter vector from the set of similar parameter vectors.

24. The method of claim 23 wherein the parameter database is a same database that is used to generate neural network training vectors.

25. The method of claim 23 wherein the parameter database is derived from neural network training vectors.

26. The method of claim 23 wherein the parameter database contains parametric representations of recorded speech and corresponding linguistic labels.

27. The method of claim 26 wherein the corresponding linguistic labels contain phonetic segment labels and segment durations.

28. The method of claim 23 wherein the representative parameter vectors consist of a sequence of parameter vectors wherein each parameter vector describes a portion of a phonetic segment.

29. The method of claim 23 wherein the representative parameter vectors are derived by:

A) segmenting the duration of each phonetic segment in the parameter database into a finite number of regions; and B) computing a parameter vector for each region.

30. The method of claim 23 wherein all of the set of similar parameter vectors are parametric representations of speech in the parameter database which correspond to speech having at least one of:

A) a same phonetic segment sequence;

B) same articulatory features;

C) same acoustic features;

D) a same stress;

E) a same prosody;

F) a same syntax; and

G) a combination of at least two of A–F.

31. A device for providing, in response to linguistic information that includes a sequence of segment descriptions each of which includes a phonetic segment type and a duration, efficient generation of a parametric representation of speech for providing synthetic speech, comprising:

A) a data selection module, coupled to receive the sequence of segment descriptions, that retrieves representative parameter vectors for each segment description according to at least the phonetic segment type and phonetic segment types included in adjacent segment descriptions;

B) an interpolation module, coupled to receive the sequence of segment descriptions and the representative parameter vectors, that interpolates between the representative parameter vectors according to the segment descriptions to provide interpolated statistical parameters;

C) a pre-processor, coupled to receive linguistic information and the interpolated statistical parameters that generates neural network input parameters;

D) a neural network with post-processor, coupled to receive neural network input parameters, that converts the neural network input parameters to neural network output parameters corresponding to a parametric representation of speech and converts the neural network output parameters to a refined parametric representation of speech, wherein the refined parametric representation of speech can be used to provide synthetic speech.

32. The device of claim 31 wherein the refined parametric representation of speech is a sequence of coder parameters suitable to be provided to a waveform synthesizer.

33. The device of claim 32 further including a waveform synthesizer, coupled to receive the sequence of coder parameters, that converts the coder parameters to synthesized speech.

34. The device of claim 31 wherein interpolation module utilizes a linear interpolation algorithm.

35. The device of claim 31 wherein the interpolation module utilizes a non-linear interpolation algorithm.

36. The device of claim 35 wherein the non-linear interpolation algorithm is a cubic spline interpolation algorithm.

37. The device of claim 35 wherein the non-linear interpolation algorithm is a Lagrange interpolation algorithm.

38. The device of claim 31 wherein elements of the interpolated statistical parameters are identical to elements generated by the statistically enhanced neural network.

39. The device of claim 31 wherein elements of the interpolated statistical parameters are derived from elements of the neural network output parameters.

40. The device of claim 31 wherein the representative parameter vectors correspond to linguistic context which is derived from one of:

A) a phonetic segment sequence;

B) articulatory features;

C) acoustic features;

D) stress;

E) prosody;

F) syntax; and

G) a combination of at least two of A–F.

41. The device of claim 31 wherein the statistically enhanced neural network is a feedforward neural network.

42. The device of claim 31 wherein the statistically enhanced neural network contains a recurrent feedback mechanism.

43. The device of claim 31 wherein the statistically enhanced neural network is a multi-layer perceptron.

44. The device of claim 31 wherein the statistically enhanced neural network uses a tapped delay line input.

45. The device of claim 31 wherein the statistically enhanced neural network is trained using a gradient descent technique.

46. The device of claim 31 wherein the statistically enhanced neural network is trained using a Bayesian technique.

47. The device of claim 31 wherein the statistically enhanced neural network is trained using back-propagation of errors.

48. The device of claim 31 wherein the statistically enhanced neural network is composed of modules wherein each module is at least one of:

A) a single layer of processing elements with a predetermined activation function;

B) a multiple layer of processing elements with predetermined activation functions;

C) a rule-based module that generates output based on internal rules and input to the rule-based module;

D) a statistical system that generates output based on input and a predetermined internal statistical function, and;

E) a recurrent feedback mechanism.

49. The device of claim 31 wherein the neural network input information includes at least one of:

A) a phoneme identifier associated with each phoneme in current and adjacent segment descriptions;

B) articulatory features associated with each phoneme in the current and adjacent segment descriptions;

C) locations of syllable, word and other predetermined syntactic and intonational boundaries;

D) duration of time between syllable, word and other predetermined syntactic and intonational boundaries E) syllable strength information;

F) descriptive information of a word type, and;

G) prosodic information which includes at least one of:

1) locations of word endings and degree of disjuncture between words;

2) locations of pitch accents and a form of the pitch accents;

3) locations of boundaries marked in pitch contours and a form of the boundaries;

4) time separating marked prosodic events, and;

5) a number of prosodic events of a predetermined type in a time period separating a prosodic event of another predetermined type and a frame for which the refined parametric representation of speech is being generated.

50. The device of claim 31 wherein the representative parameter vectors are generated by using a clustering algorithm.

51. The device of claim 50 wherein the clustering algorithm is a k-means clustering algorithm.

52. The device of claim 31 wherein the representative parameter vectors are generated by using a predetermined averaging algorithm.

53. The device of claim 31 wherein the representative parameter vectors are derived by:

A) extracting vectors from a parameter database to create a set of similar parameter vectors; and B) computing a representative parameter vector from the set of similar parameter vectors.

54. The device of claim 53 wherein the parameter database is a same database that is used to generate neural network training vectors.

55. The device of claim 53 wherein the parameter database are derived from the neural network training vectors.

56. The device of claim 53 wherein the parameter database contains parametric representations of recorded speech and corresponding linguistic labels.

57. The device of claim 56 wherein the corresponding linguistic labels contain phonetic segment labels and segment durations.

58. The device of claim 53 wherein the representative parameter vectors consist of a sequence of parameter vectors wherein each parameter vector describes a predetermined portion of a phonetic segment.

59. The device of claim 53 wherein the representative parameter vectors are derived by:

A) segmenting the duration of each phonetic segment in the parameter database into a finite number of regions; and B) computing a parameter vector for each region.

60. The device of claim 53 wherein all of the set of similar parameter vectors are parametric representations of speech in the parameter database which correspond to speech having at least one of:

A) a same phonetic segment sequence;

B) same articulatory features;

C) same acoustic features;

D) a same stress;

E) a same prosody;

F) a same syntax; and

G) a combination of at least two of A–F.

61. A text-to-speech system/speech synthesis system/dialog system having a device for providing, in response to linguistic information that includes a sequence of segment descriptions each of which includes a phonetic segment type and a duration, efficient generation of a parametric representation of speech for providing synthetic speech, the device comprising:

A) a data selection module, coupled to receive the sequence of segment descriptions, that retrieves representative parameter vectors for each segment description according to at least the phonetic segment type and phonetic segment types included in adjacent segment descriptions;

B) an interpolation module, coupled to receive the sequence of segment descriptions and the representative parameter vectors, that interpolates between the representative parameter vectors according to the segment descriptions to provide interpolated statistical parameters;

C) a pre-processor, coupled to receive linguistic information and the interpolated statistical parameters that generates neural network input parameters;

D) a neural network with a post-processor, coupled to receive neural network input parameters, that converts the neural network input parameters to neural network output parameters that correspond to a parametric representation of speech; and where selected, including a post-processor, coupled to receive the neural network output parameters that converts the neural network output parameters to a refined parametric representation of speech, wherein the refined parametric representation of speech can be used to provide synthetic speech.

62. The text-to-speech system/speech synthesis system/dialog system of claim 61 wherein the refined parametric representation of speech is a sequence of coder parameters suitable to be provided to a waveform synthesizer.

63. The method of claim 62 further including a waveform synthesizer, coupled to receive the sequence of coder parameters, that converts the refined parametric representation of speech to synthesized speech.

64. The text-to-speech system/speech synthesis system/dialog system of claim 61 wherein interpolation module utilizes a linear interpolation algorithm.

65. The text-to-speech system/speech synthesis system/dialog system of claim 61 wherein the interpolation module utilizes a non-linear interpolation algorithm.

66. The text-to-speech system/speech synthesis system/dialog system of claim 61 wherein the non-linear interpolation algorithm is a cubic spline interpolation algorithm.

67. The text-to-speech system/speech synthesis system/dialog system of claim 61 wherein the non-linear interpolation algorithm is a Lagrange interpolation algorithm.

68. The text-to-speech system/speech synthesis system/dialog system of claim 61 wherein elements of the interpolated statistical parameters are identical to elements generated by the neural network output.

69. The text-to-speech system/speech synthesis system/dialog system of claim 61 wherein elements of the interpolated statistical parameters is derived from elements of the neural network output parameters.

70. The text-to-speech system/speech synthesis system/dialog system of claim 61 wherein the representative parameter vectors correspond to linguistic context which is derived from one of:

A) phonetic segment sequence;

B) articulatory features;

C) acoustic features;

D) stress;

E) prosody;

F) syntax; and

G) a combination of at least two of A–F.

71. The text-to-speech system/speech synthesis system/dialog system of claim 61 wherein the statistically enhanced neural network is a feedforward neural network.

72. The text-to-speech system/speech synthesis system/dialog system of claim 61 wherein the statistically enhanced neural network contains a recurrent feedback mechanism.

73. The text-to-speech system/speech synthesis system/dialog system of claim 61 wherein the statistically enhanced neural network is a multi-layer perceptron.

74. The text-to-speech system/speech synthesis system/dialog system of claim 61 wherein the statistically enhanced neural network uses a tapped delay line input.

75. The text-to-speech system/speech synthesis system/dialog system of claim 61 wherein the statistically enhanced neural network is trained using a gradient descent technique.

76. The text-to-speech system/speech synthesis system/dialog system of claim 61 wherein the statistically enhanced neural network is trained using a Bayesian technique.

77. The text-to-speech system/speech synthesis system/dialog system of claim 61 wherein the statistically enhanced neural network is trained using back-propagation of errors.

78. The text-to-speech system/speech synthesis system/dialog system of claim 61 wherein the statistically enhanced neural network is composed of modules wherein each module is at least one of:

A) a single layer of processing elements with a specified activation function;

B) a multiple layer of processing elements with specified activation functions;

C) a rule based module that generates output based on internal rules and input to the rule based module;

D) a statistical system that generates output based on input and an internal statistical function, and;

E) a recurrent feedback mechanism.

79. The text-to-speech system/speech synthesis system/dialog system of claim 61 wherein the neural network input information includes at least one of:

A) phoneme identifier associated with each phoneme in current and adjacent segment descriptions;

B) articulatory features associated with each phoneme in current and adjacent segment descriptions;

C) locations of syllable, word and other syntactic and intonational boundaries;

D) duration of time between syllable, word and other syntactic and intonational boundaries E) syllable strength information;

F) descriptive information of a word type, and;

G) prosodic information which includes at least one of:

1) locations of word endings and degree of disjuncture between words;

2) locations of pitch accents and a form of the pitch accents;

3) locations of boundaries marked in pitch contours and a form of the boundaries;

4) time separating marked prosodic events, and;

5) a number of prosodic events of a predetermined type in a time period separating a prosodic event of another predetermined type and a frame for which the refined parametric representation of speech is being generated.

80. The text-to-speech system/speech synthesis system/dialog system of claim 61 wherein the representative parameter vectors were generated by using a clustering algorithm.

81. The text-to-speech system/speech synthesis system/dialog system of claim 80 wherein the clustering algorithm is a k-means clustering algorithm.

82. The text-to-speech system/speech synthesis system/dialog system of claim 61 wherein the representative parameter vectors were generated by using an averaging algorithm.

83. The text-to-speech system/speech synthesis system/dialog system of claim 61 wherein the representative parameter vectors are derived by A) extracting vectors from a parameter database to create a set of similar parameter vectors; and B) computing a representative parameter vector from the set of similar parameter vectors.

84. The text-to-speech system/speech synthesis system/dialog system of claim 83 wherein the parameter database is a same database that is used to generate neural network training vectors.

85. The text-to-speech system/speech synthesis system/dialog system of claim 84 wherein the parameter database is derived from the neural network training vectors.

86. The text-to-speech system/speech synthesis system/dialog system of claim 85 wherein the parameter database contains parametric representations of recorded speech and corresponding linguistic labels.

87. The text-to-speech system/speech synthesis system/dialog system of claim 86 wherein the corresponding linguistic labels contain phonetic segment labels and segment durations.

88. The text-to-speech system/speech synthesis system/dialog system of claim 83 wherein the representative parameter vectors consist of a sequence of parameter vectors wherein each parameter vector describes a portion of a phonetic segment.

89. The text-to-speech system/speech synthesis system/dialog system of claim 83 wherein the representative parameter vectors are derived by A) segmenting the duration of each phonetic segment in the parameter database into a finite number of regions; and B) computing a parameter vector for each region.

90. The text-to-speech system/speech synthesis system/dialog system of claim 89 wherein the set of similar parameter vectors are all parametric representations of speech in the parameter database which correspond to speech having a same:

A) phonetic segment sequence;

B) articulatory features;

C) acoustic features;

D) stress;

E) prosody;

F) syntax; and

G) a combination of at least two of A–F.

* * * * *